US007546872B2

(12) United States Patent
McGilvray, Jr. et al.

(10) Patent No.: US 7,546,872 B2
(45) Date of Patent: Jun. 16, 2009

(54) LINER HANGER

(75) Inventors: Mark A. McGilvray, Jr., Houston, TX (US); James M. Fraser, III, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 367 days.

(21) Appl. No.: 11/635,976

(22) Filed: Dec. 8, 2006

(65) Prior Publication Data

US 2008/0135261 A1 Jun. 12, 2008

(51) Int. Cl.
*E21B 23/00* (2006.01)
*E21B 43/10* (2006.01)

(52) U.S. Cl. ..... 166/208; 166/212; 166/217; 166/382

(58) Field of Classification Search ..... 166/208, 166/212, 217, 382
See application file for complete search history.

(56) References Cited

U.S. PATENT DOCUMENTS 4,497,367 A * 2/1985 Stevenson ..... 166/208
4,497,368 A 2/1985 Baugh
4,711,326 A 12/1987 Baugh et al.
4,762,177 A 8/1988 Smith, Jr.
5,002,131 A * 3/1991 Cromar et al. ..... 166/382
5,086,845 A 2/1992 Baugh
5,417,288 A 5/1995 Melenyzer et al.
6,431,277 B1 8/2002 Cox et al.
2006/0278404 A1 12/2006 Fay

* cited by examiner

*Primary Examiner*—Giovanna C Wright
(74) *Attorney, Agent, or Firm*—Greenberg Traurig LLP; Anthony F. Matheny

(57) ABSTRACT

An improved liner hanger comprises a mandrel having a piston housing and a plurality of spring slots disposed on the outer wall surface of the mandrel. Each spring slot having at least one spring disposed therein. The liner hanger also has a slip housing having a plurality of slips operatively associated therewith, a spring adjustment sleeve, and an adjustment sleeve ring. The location of the spring slots on the outer wall surface of the mandrel permits an increase in the number of springs utilized for setting the liner hanger. The spring adjustment sleeve and adjustment sleeve ring permit easy and safe assembly and disassembly of the liner hanger. Additionally, when actuated to move from its run-in position to its set position, springs, slip housing, and slips all move upward.

19 Claims, 10 Drawing Sheets

LINER HANGER

BACKGROUND

1. Field of Invention

The invention is directed to anchoring slip assemblies and, in particular, liner hanger devices used for suspending a liner within a wellbore.

2. Description of Art

A liner is a tubular member that is usually run inside of wellbore casing of an oil or gas well and suspended within the wellbore casing. Liners are typically secured within a wellbore by toothed slips that are located on liner hangers. The slips are set by axially translating them with respect to the liner hanger mandrel or housing. As the slips are translated axially, they are cammed radially outwardly by a ramped surface that is fashioned into the mandrel. As the slips move radially outwardly, the toothed surfaces of the slip will bitingly engage the inner wall surface of the wellbore casing. This type of arrangement is shown, for example, in U.S. Pat. No. 4,497,368 in which slips that are radially expanded by riding up over cone elements disposed into the tubular body of the central mandrel.

Actuation systems for such slips in the past employed full circumference hydraulically actuated pistons to move the slips. These designs presented a pressure rating problem in that the full circumference piston frequently had a maximum working pressure significantly lower than the mandrel which it surrounded. Thus, this type of design limited the maximum working pressure in the string to the rating of the cylindrical piston housing assembly. For example, it was not unusual in prior designs to have mandrels rated for 12,000 PSI while the surrounding cylinder housing for the cylindrical piston to only have a rating of approximately 3,000 PSI.

In an effort to improve the shortcoming of this design, another design illustrated in U.S. Pat. No. 5,417,288 was developed. In this design the mandrel body received a pair of bores straddling each of the slips. A piston assembly was mounted in each of the bores with all of the necessary seals. The application of hydraulic pressure in the mandrel into all the piston bores actuated the pistons on either side of each slip through a common sleeve to which all the slips were attached. This design, however, was expensive to manufacture, had many potential leak paths in the form of the ring seals on each of the pistons wherein each slip required two pistons.

On the other hand, this design provided for a higher pressure rating for the liner hanger body and also used the hydraulic pressure directly to actuate the slips. Necessarily it did not include a locking feature against premature slip movements due to inadvertently applied pressures. The design in U.S. Pat. No. 5,417,288 also did not provide for flexibility for changed conditions downhole which could require additional force to set the slips. In essence, each application was designed for a pre-existing set of conditions with field variability not included as a feature of that prior art design.

Additionally, the design of the liner hanger needs to accommodate circulation of mud and cement. The foregoing prior designs, particularly those using a cylindrical piston, obstructed the passages that could have been used for circulating cement and mud.

Slip assemblies in the past also have been configured in a variety of ways. In one configuration, when the slips are actuated, the load is passed through the slips circumferentially through their guides or retainers and transmission of the load to the underlying mandrel is avoided. In other more traditional designs, the slips are driven along tapered surfaces of a supporting cone and the loading is placed on the supporting mandrel is in a radial direction toward its center, thus tending to deform the mandrel when setting the slips. Typical of such applications are U.S. Pat. Nos. 4,762,177, 4,711,326 and 5,086,845.

In another prior attempt, illustrated in U.S. Pat. No. 6,431,277, the slips are designed to move in two directions upon being actuated. The slips initially move in the direction of the actuating piston, but reverse direction through the movement of one or more springs energized to expand in the direction opposite of the actuating piston. The liner hanger in this patent is also designed with a separate spring housing that restricts the total number of springs that can be used and is difficult to assemble.

Also, the liner hanger disclosed in U.S. Pat. No. 6,431,277 does not allow the operator to disassemble the liner hanger in the event that the liner hanger is not set within the wellbore. For example, sometimes the liner hanger must be modified, or repaired, prior to installation. In many instances, the modifications or repairs cannot be accomplished while the liner hanger is "energized" for placement within the wellbore. Therefore, the liner hanger is actuated by activating the piston and the spring and, thus, releasing the slips. Accordingly, before the liner hanger can be installed within the wellbore, the entire liner hanger must be reassembled causing increased downtime and costs.

Further, the liner hanger disclosed in U.S. Pat. No. 6,431,277 utilized a piston having a passageway disposed longitudinally therethrough. The passageway is used to vent and/or oil the piston within the piston housing. As a result, the mass of the piston was lessened which also lessened the amount of energy the piston was capable of releasing upon actuation.

Accordingly, prior to the development of the present invention, there has been no liner hanger that: provides an easy to assemble and disassemble liner hanger; provides a vent port for venting and oiling the piston such that the piston can be solid instead of having a passageway running the length of the piston; and provides an increase in the number of springs use to set the slips of the liner hanger, thereby providing a better initial bite of the slips into the wellbore casing. Therefore, the art has sought a liner hanger that: provides an easy to assemble and disassemble liner hanger; provides a vent port for venting and oiling the piston such that the piston can be solid instead of having a passageway running the length of the piston; and provides an increase in the number of springs use to set the slips of the liner hanger, thereby providing a better initial bite of the slips into the wellbore casing.

SUMMARY OF INVENTION

Broadly, an improved liner hanger for securing within a wellbore casing is disclosed. The liner hanger includes a mandrel having a piston housing and a plurality of spring slots disposes circumferentially around the outer surface of the mandrel. Each spring slot contains at least one spring that is compressed or "energized" when the liner hanger is in the run-in position. The springs are held in place by a spring adjustment sleeve having a shoulder that abuts up against one end of each spring and compresses or energizes each spring by forcing the other end of each spring against a slip housing circumferentially disposed around the outer surface of the mandrel below the spring slots and the piston housing.

The piston housing contains a piston port for receiving a piston. The piston housing preferably includes a vent port disposed along the length of the piston port so that, after a piston is installed within the piston port, the piston port can be vented and/or oiled along the length of the piston port. As a result, a solid piston can be used in the liner hanger. Use of solid piston as opposed to a hollow piston provides a piston that imparts greater energy when actuated due to its greater mass.

The slip housing contains a plurality of slips operatively associated therewith. Each slip is designed to slide within a reciprocal slip pocket disposed on the outer surface of the mandrel. In one embodiment, each slip pocket includes at least one groove and the corresponding slip includes a ramp slidingly engaged within the groove. Each slip also includes a gripping profile surface for engaging or biting into the wellbore casing. Each slip is initially disposed within its corresponding slip pocket until the hanger liner is set within the wellbore casing. During setting of the liner hanger within the wellbore casing, each slip moves axially and radially outward to engage or bite into the wellbore casing, thus securing the hanger liner within the wellbore casing.

The slip housing includes a key initially held in place by a shear screw. The key maintains a split ring in place until the key is actuated by the piston. Upon actuation of the piston, the piston extends into the key, forcing the key to release the split ring. As a result of the split ring being released by the key, the slip housing is permitted to move axially along the length of the mandrel. Additionally, as a result of the split ring being released by the key, each of the springs in the spring slots are allowed to expand and release their stored energy. Therefore, expansion of the springs forces the slip housing to move upward axially which in turn forces each of the slips in communication with the slip housing to move upward and outward, i.e., radially, until the slips bite into the wellbore casing and the hanger liner becomes set within the wellbore casing.

As will be recognized by persons of ordinary skill in the art, the setting of the liner hanger is done through movement of the springs, slip housing, and slips in the same direction. As will also be recognized by persons of ordinary skill in the art, the increase in the number of springs around the outer surface of the mandrel increases the amount of energy and, thus, force that can be released to initially set, or bite, each of the slips into the wellbore casing. Accordingly, the liner hanger can be better secured to the wellbore casing.

In one aspect, one or more of the foregoing advantages may be achieved through the a liner hanger for securing to the inner wall of a wellbore casing and having an initial run-in position and a set position. The liner hanger comprises a mandrel having an inner wall surface defining a bore and an outer wall surface, the outer wall surface having at least one slip pocket, a plurality of spring slots, each spring slot having at least one spring disposed therein, and a piston housing, the piston housing having at least one piston disposed therein, wherein the piston is in fluid communication with the bore; and a slip housing disposed below the piston housing and each of the spring slots, the slip housing being slidingly engaged with the outer wall surface of the mandrel and having at least one slip operatively associated therewith, each of the at least one slips being disposed within a corresponding slip pocket, wherein the slip housing is held in the run-in position by the retainer so that each of the slips is disposed within each of the corresponding slip pockets, and wherein actuation of the piston causes the retainer to release the slip housing allowing each of the plurality of springs to move the slip housing upward axially from the run-in position to the set position which causes each of the slips to move upward axially and radially relative to the corresponding slip pockets and the mandrel to engage the inner wall of the wellbore casing.

A further feature of the liner hanger is that the mandrel may include a split ring groove and the retainer may be a split ring disposed within the split ring groove, the split ring being operatively associated with a key. Another feature of the liner hanger is that the slip housing may include an inner wall surface having a groove for receiving the split ring and a pocket for receiving the key and wherein the slip housing contacts each of the plurality of springs when the liner hanger is in the run-in position. An additional feature of the liner hanger is that the key may be in contact with the piston when the liner hanger is in the run-in position. Still another feature of the liner hanger is that the key may be held in place by a shear screw when the liner hanger is in the run-in position. A further feature of the liner hanger is that the key may include a body, a pair of opposed surfaces, a tab, and a shear screw hole for receiving the shear screw, the pair of opposed surfaces being matingly engaged with a corresponding pair of opposed shoulders on the split ring when the liner hanger is in the run-in position. Another feature of the liner hanger is that the line hanger may further comprise a spring adjustment sleeve for compressing and maintaining each of the springs within the corresponding spring slots when the liner hanger is in the run-in position. An additional feature of the liner hanger is that the spring adjustment sleeve may include threads on an inner wall surface of the spring adjustment sleeve. Still another feature of the liner hanger is that the liner hanger may further comprise an adjustment sleeve ring for securing the spring adjustment sleeve to the mandrel and wherein the spring adjustment sleeve includes a protrusion slidingly engaged with a slot on the mandrel for aligning the spring adjustment sleeve on the mandrel. A further feature of the liner hanger is that the adjustment sleeve ring may include a set screw for preventing the adjustment sleeve ring from loosening. Another feature of the liner hanger is that the adjustment sleeve ring may include threads for securing the adjustment sleeve ring to the outer wall surface of the mandrel. An additional feature of the liner hanger is that the spring adjustment sleeve may include a shoulder for abutting each of the springs. Still another feature of the liner hanger is that each of the plurality of slips may include a first end having a T-shaped protrusion that matingly engages with a T-slot in the slip housing. A further feature of the liner hanger is that the piston port may include a length and a vent port disposed along the piston port length and in fluid communication with the piston port and an environment outside the mandrel. Another feature of the liner hanger is that each of the springs may include a spring nail. An additional feature of the liner hanger is that each of the plurality of slips may include a gripping wall surface having pyramidal-shaped teeth.

In another aspect, one or more of the foregoing advantages may be achieved through an improved liner hanger having a run-in position and a set position. The improvement comprises a plurality of spring slots disposed on an outer wall surface of a mandrel, at least one of the plurality of spring slots having at least one spring disposed therein.

A further feature of the improved liner hanger is that each of the at least one springs may be held within the corresponding spring slots by a slip housing and a spring adjustment sleeve disposed on the outer wall surface of the mandrel when the liner hanger is in the run-in position. Another feature of the improved liner hanger is that the spring adjustment sleeve may include a shoulder disposed on an inner wall surface of the spring adjustment sleeve. An additional feature of the improved liner hanger is that the inner wall surface of the spring adjustment sleeve may include threads for securing the spring adjustment sleeve to the outer wall surface of the mandrel.

In an additional aspect, one or more of the foregoing advantages may be achieved through a method of setting a liner hanger within the wellbore casing of a well. The method comprises: (a) disposing a liner hanger within a wellbore, the liner hanger having an initial run-in position and a set position and the liner hanger comprising a mandrel having an inner wall surface defining a bore and an outer wall surface, the outer wall surface having at least one slip pocket, a split ring groove, a plurality of spring slots, each spring slot having at least one spring disposed therein, and a piston housing, the piston housing having at least one piston disposed therein, wherein the piston is in fluid communication with the bore, and a slip housing disposed below the piston housing and each of the spring slots, the slip housing being slidingly engaged with the outer wall surface of the mandrel and having at least one slip operatively associated therewith, each of the at least one slips having a gripping wall surface and being slidingly engaged within a corresponding slip pocket, wherein the slip housing is held in the run-in position by a retainer so that each of the slips is disposed within each of the corresponding slip pockets; (b) actuating the piston through an increase in pressure in the bore of the mandrel, wherein the actuation of the piston releases the retainer so that the slip housing is permitted to move axially along the outer wall surface of the mandrel and each of the springs is permitted to expand in an upward direction; and (c) expanding in the upward direction each of the springs sufficiently to move the slip housing axially in the upward direction so that each of the plurality of slips move axially in the upward direction causing each of the slips to move in the upward direction and in an outward direction so that the gripping profile surface of each of the slips bites into an inner wall surface of the wellbore casing.

A further feature of the method of setting a liner hanger within the wellbore casing of a well is that each of the slip pockets may include at least one groove for receiving at least one slip ramp disposed on at least one of the slips so that during step (c) movement of each of the slips is guided by the at least one groove.

The liner hangers disclosed herein have one or more the advantages of: providing an easy to assemble and disassemble liner hanger; providing a vent port for venting and oiling the piston such that the piston can be solid instead of having a passageway running the length of the piston; and providing an increase in the number of springs use to set the slips of the liner hanger, thereby providing a better initial bite of the slips into the wellbore casing.

Figure 1A:
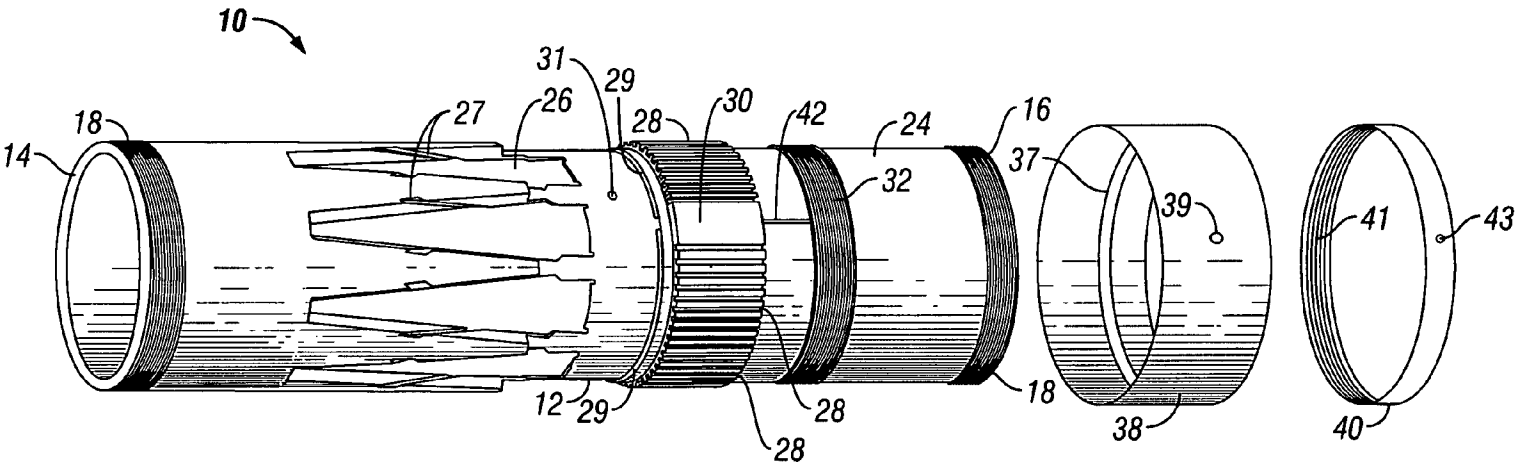
FIG. 1A is a prospective and exploded view of the mandrel, spring adjustment sleeve, and sleeve adjustment ring of one specific embodiment of the liner hanger disclosed herein.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-13, in one specific embodiment, liner hanger 10 comprises body or mandrel 12 having bore 13, upper end 14, and a lower end 16. Both upper end 14 and lower end 16 are in fluid communication with bore 13 and are adapted to receive additional components of string (not shown). For example, lower end 16 includes threads 18 for matingly engaging another component such as a packer (not shown). As shown in FIG. 2A, upper end 14 also includes threads 18 for attachment to a blow-out preventer, diverter, Christmas tree, riser, tubing, casing, or other piece of equipment.

The outer wall surface 24 of mandrel 12 includes a plurality of slip pockets 26, a plurality of spring slots 28, piston housing 30, and ring threads 32. As shown in FIGS. 1A, 2B, 3A, 3D, 5 and 6, piston housing 30 is disposed between spring slots 28. Each slip pocket 26 is designed to receive a slip 70; each spring slot 28 is designed to receive a spring 36; and ring threads 32 are for securing spring adjustment sleeve 38 by sleeve adjustment ring 40 having threads 41.

Figure 8:
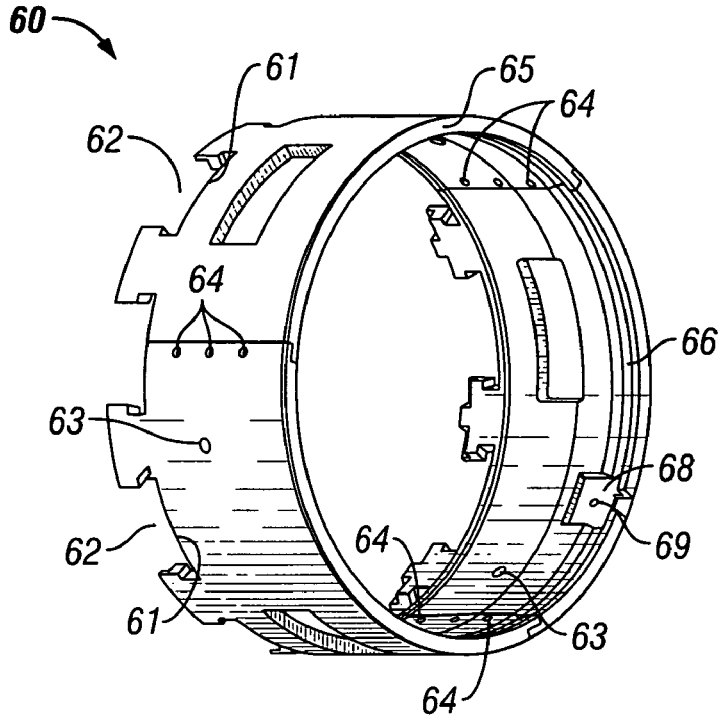
FIG. 8 is a perspective view of the slip housing of one specific embodiment of the liner hanger disclosed herein.

Spring adjustment sleeve 38 is a cylindrical housing having an inner diameter that fits snuggly over spring slots 28 and piston housing 30. On the inner surface of spring adjustment sleeve 38 is shoulder 37 for seating against one end of each spring slot 28 and, thus, one end of each spring 36 disposed in each spring slot 28. During assembly of liner hanger 10, after slips 70 and slip housing 60 are installed as discussed in greater detail below, springs 36 (also discussed in greater detail below) are placed in spring slots 28. In so doing, one end of each spring 36 is held fast by slip housing 60. Spring adjustment sleeve 38 is then slid over mandrel 12 until each spring 36 abuts shoulder 37 and also face 65 of slip housing 60 (FIG. 8). Sleeve adjustment ring 40 is then slid over mandrel 12 until threads 41 contact with threads 32. Sleeve adjustment ring 40 is then screwed onto mandrel 12 and spring adjustment sleeve 38 is slowly moved down the length of mandrel 12 causing each spring 36 to be compressed and, thus, energized. Alternatively, as shown in FIG. 1B, spring adjustment sleeve 38 includes threads 35 or other securing structure on the inner wall surface of spring adjustment sleeve 38 so that sleeve adjustment ring 40 is not needed.

Because sleeve adjustment ring 40 and, thus, spring adjustment sleeve 38 can be easily and slowly installed and removed, liner hanger 10 can easily and safely be assembled and disassembled as necessary. Therefore, in situations where liner hanger 10 cannot be installed and cannot be repaired unless one or more of springs 36, (discussed below), or split ring 80 (discussed below) being actuated or released as in prior liner hangers, in one aspect of the liner hanger 10 disclose herein, liner hanger 10 can be easily disassembled in a controlled and safe manner and without the need for releasing the split ring or actuating the piston. Further, liner hanger 10 can be easily reassembled without the need for fixturing tools that are needed to recompress the springs as in prior liner hangers.

In a preferred embodiment, mandrel 12 includes at least one, and preferably two, set screw slots 42 for guiding a protrusion, e.g., screw 39 (shown in FIGS. 3A and 3D), on sleeve 38 when spring adjustment sleeve 38 is being secured in place against springs 36 by sleeve adjustment ring 40. Preferably, sleeve adjustment ring 40 includes set screw 43 (shown in FIGS. 3A and 3D) for restricting sleeve adjustment ring 40 from backing-off ring threads 32.

Slip pockets 26 are spaced circumferentially apart from each other and around outer surface 24 of mandrel 12. Each slip pocket 26 has a shape that is substantially reciprocal to a corresponding slip 70 (described in greater detail below) so that slip 70 is held within slip pocket 26 when liner hanger 10 is in its unset position (FIG. 3A) and so that slip 70 will be held fast when liner hanger 10 is placed in its set position (FIG. 3D), i.e., with each slip 70 biting into the wellbore casing (not shown). In an alternative embodiment, a portion of outer wall surface 24 has wickers (not shown) or other gripping profile adapted to facilitate gripping the inner wall of the wellbore casing. In other words, in this embodiment, slip pockets 26 and, thus, slips 70 do not completely cover the circumference of outer wall surface 24.

Figure 1B:
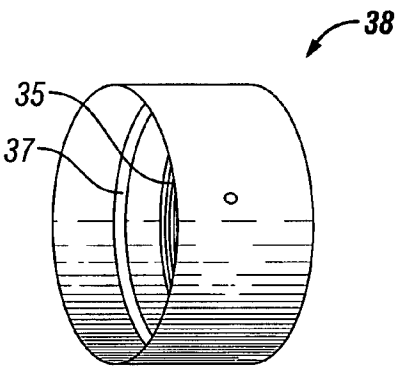
FIG. 1B is a prospective view of a spring adjustment sleeve for use in another specific embodiment of the liner hanger disclosed herein.
Figure 2A:
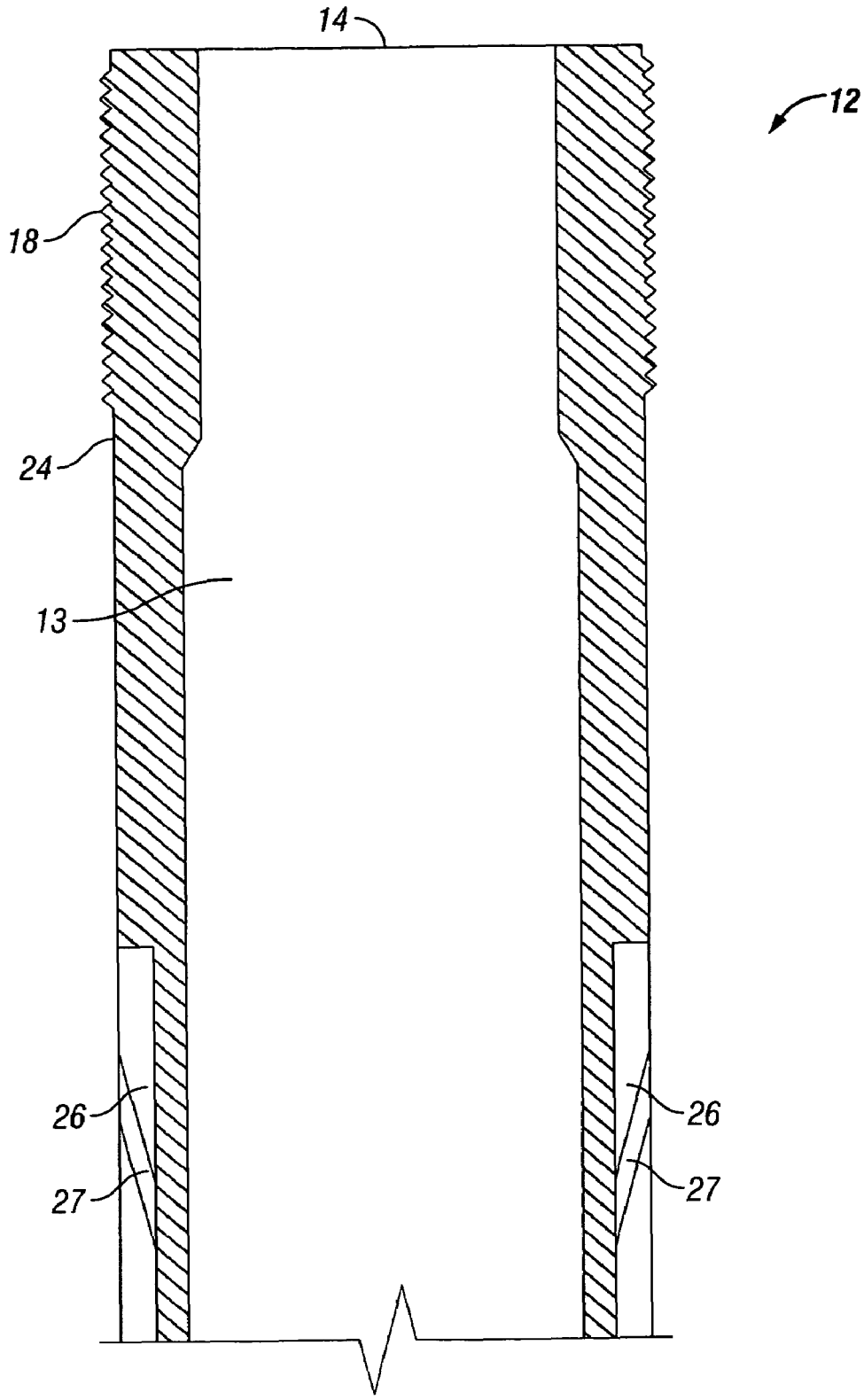
FIG. 2A is a partial cross-sectional view of a top portion of the mandrel of the liner hanger shown in FIG. 1A.
Figure 2B:
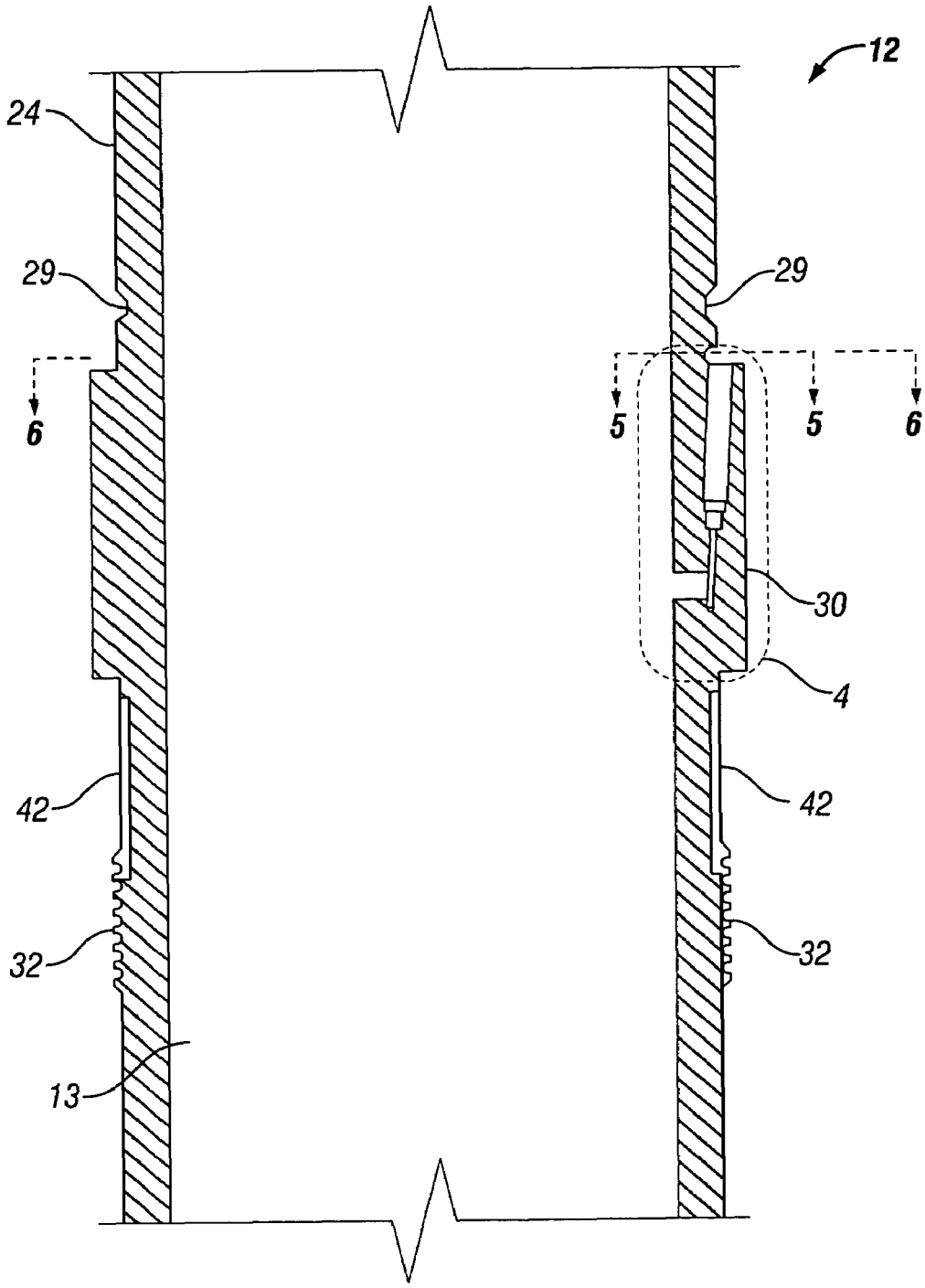
FIG. 2B is a partial cross-sectional view of a middle portion of the mandrel of the liner hanger shown in FIG. 1A.
Figure 2C:
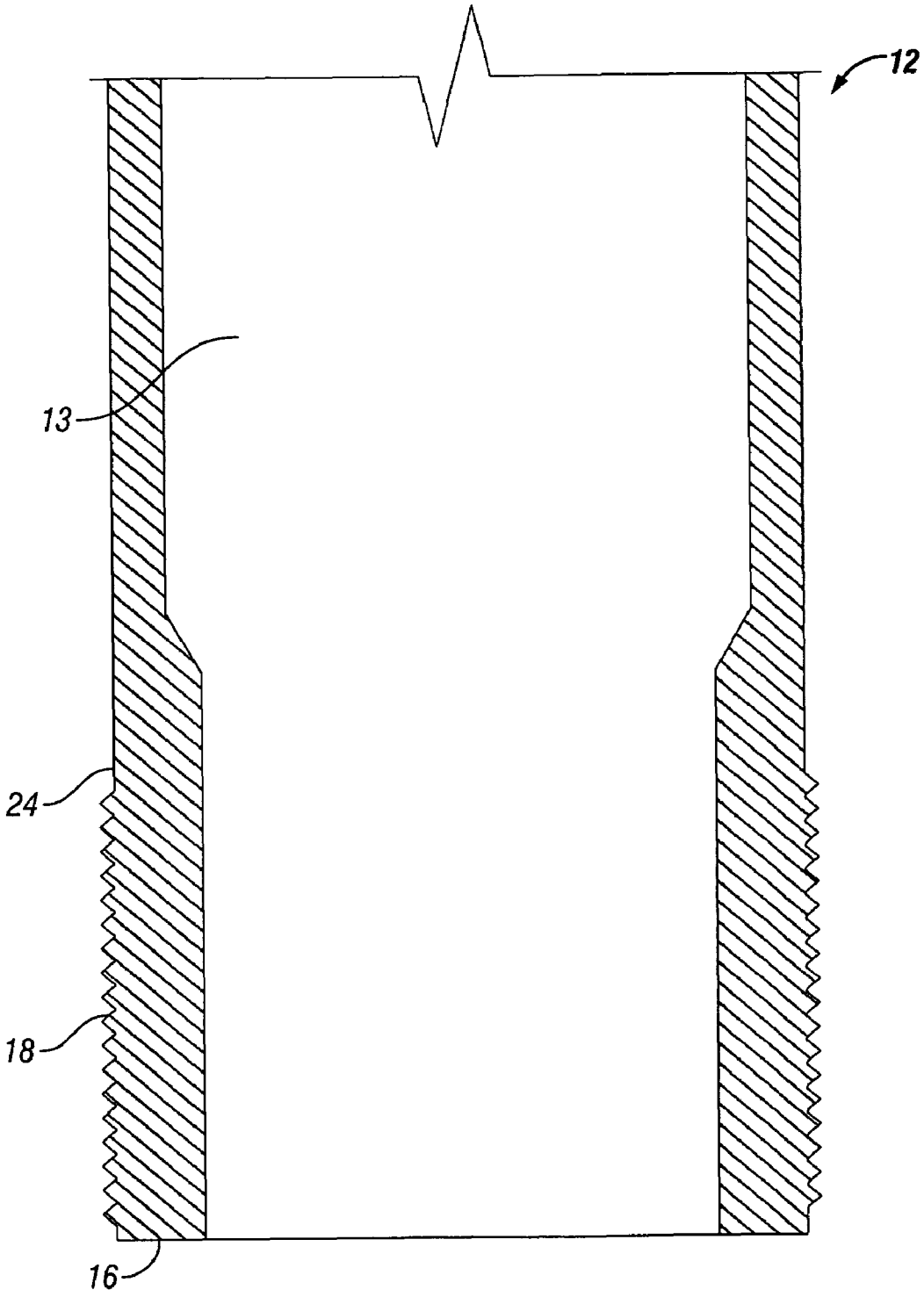
FIG. 2C is a partial cross-sectional view of a bottom portion of the mandrel of the liner hanger shown in FIG. 1A.
Figure 3A:
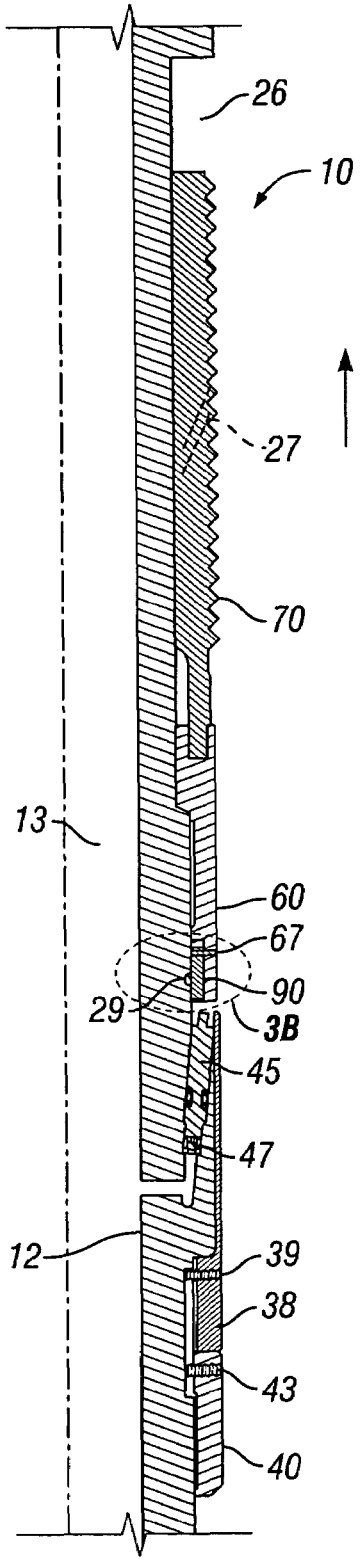
FIG. 3A is a cross-sectional view of one specific embodiment of an assembled liner hanger disclosed herein shown in the run-in position and having the mandrel, spring adjustment sleeve, and sleeve adjustment ring shown in FIG. 1A and the mandrel shown in FIGS. 2A-2C.
Figure 3B:
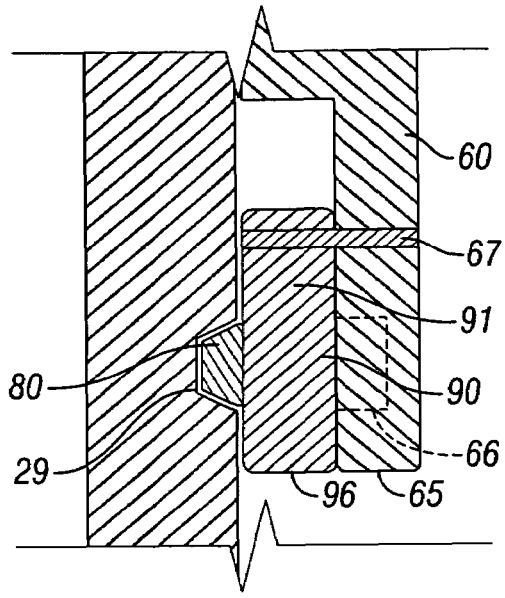
FIG. 3B is a detailed cross-sectional view of the slip housing, key, split ring, and shear screw identified by reference number 3B in the portion of the liner hanger shown in FIG. 3A.
Figure 3C:
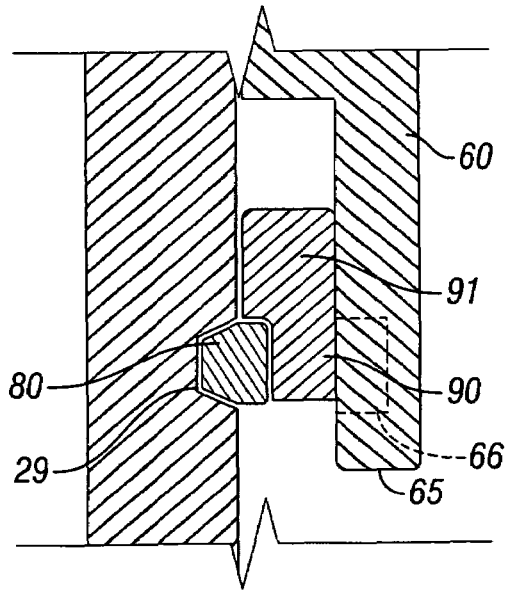
FIG. 3C is a rotated cross-sectional view of the slip housing, key, and split ring shown in FIG. 3B.
Figure 3D:
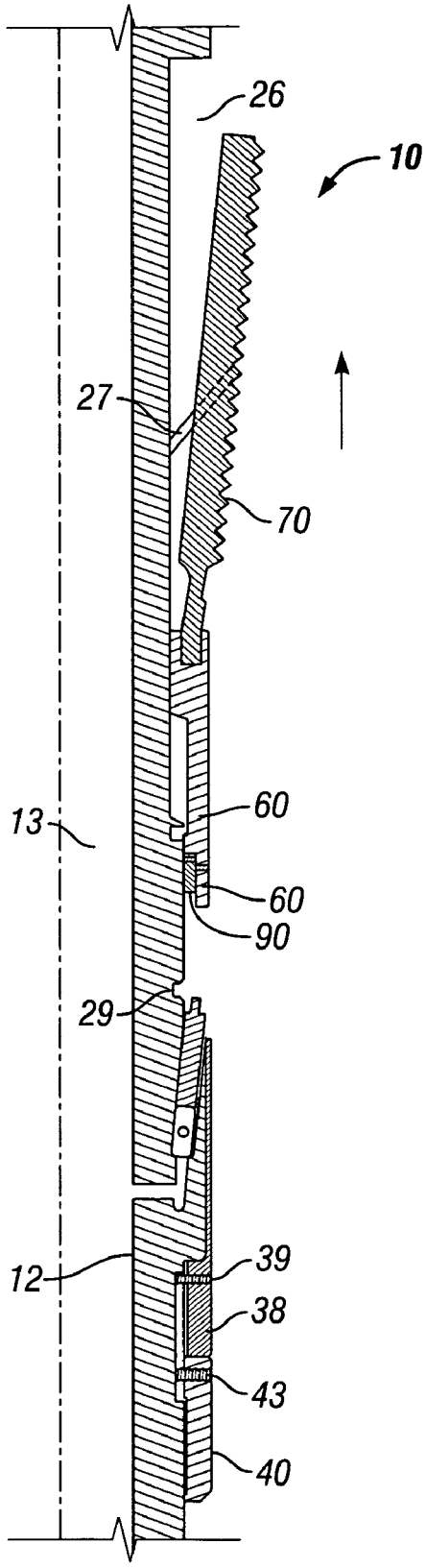
FIG. 3D is a cross-sectional view of liner hanger shown in FIG. 3A shown in the set position.

As best shown in FIGS. 1A, 3A and 3D, each slip pocket 26 includes a length and a width that is smaller than its length and which may vary along its length as shown in FIG. 1A. Preferably the depth of each slip pocket 26 along its length and its width is constant. Slip pocket 26 also includes slip grooves 27 (FIGS. 1A, 2C, and 3A) for receiving slip ramps 74 (FIG. 9) which are described in greater detail below in relation to slip 70. Slip grooves 27 provide a circumferential force component, or loading, of mandrel 12 when slips 70 are moved axially upward and, thus, extended radially into the wellbore casing.

Figure 11:
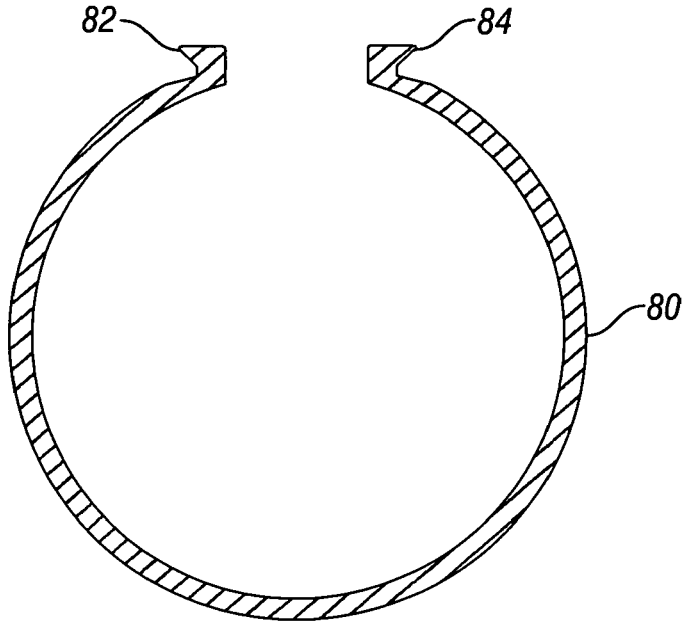
FIG. 11 is a cross-sectional view of a split ring of one specific embodiment of the liner hanger disclosed herein.

Split ring groove 29 (FIGS. 1A, 2B, 3A, and 3D) is disposed within outer wall surface 24 for receiving split ring 80 (FIG. 11). Split ring groove 29 is disposed between slip pockets 26 and spring slots 28/piston housing 30. As discussed in greater detail below with respect to slip housing 60, split ring 80 is held in place by key 90 disposed on the inner wall surface of slip housing 60 until piston 45 is actuated, forcing key 90 off of split ring groove 29 to release split ring 80, causing springs 36 to expand and force slip housing 60 in the direction of the arrow (FIGS. 3A and 3D) and, thus, setting slips 70 into the wellbore casing. In this embodiment, split ring 80, split ring groove 29 and key 90 are considered a retainer for retaining slip housing 60 in the run-in position (FIG. 3A). It is to be understood, however, that retainer can be any structural component or components known to persons of ordinary skill in the art for releasably retaining slip housing 60 in the run-in position (FIG. 3A).

Figure 4:
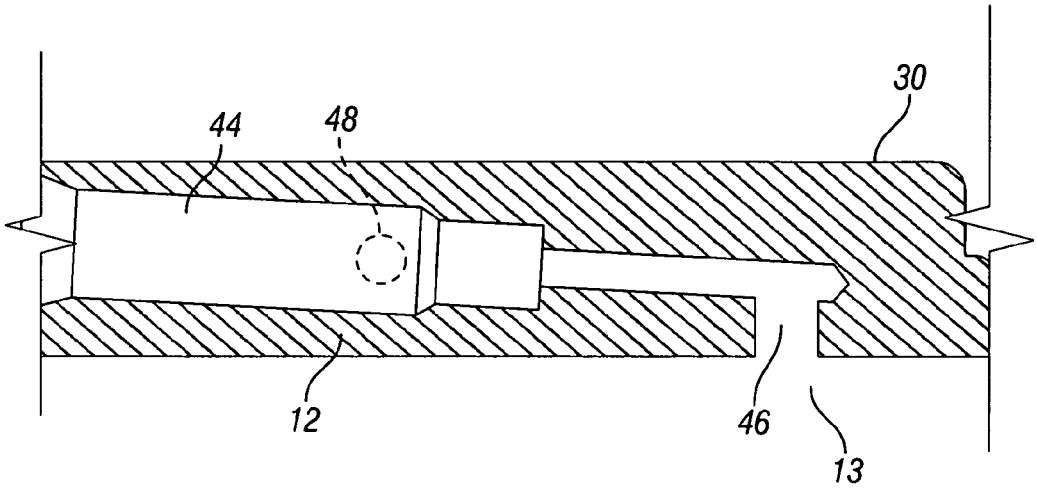
FIG. 4 is an enlarged cross-sectional view of the piston housing identified by the reference number 4 in the portion of the mandrel shown in FIG. 2B.
Figure 5:
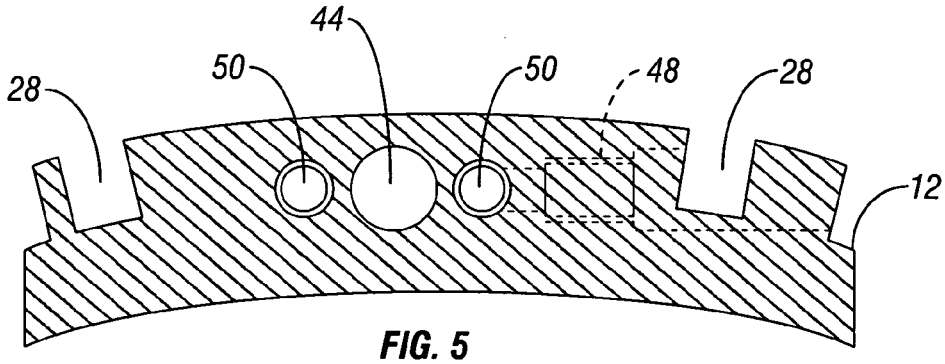
FIG. 5 is a partial cross-sectional view of the piston housing of the mandrel shown in FIG. 2B taken along line 5-5.

Referring now to FIGS. 4-5, piston housing 30 includes piston port 44 that is in fluid communication with bore 13 through communication port 46. Vent port 48 places piston port 44 in fluid communication with the outside environment so that piston port 44 can be vented and receive oil when piston 45 (shown in FIG. 3A) is disposed within piston port 44. Thus, a solid piston 45 can be used instead of a piston having a longitudinal passageway through which pressure can be vented and oil can be injected. As shown in FIG. 5, vent port 48 transverses one or more spring slots 28. Also, as shown in FIG. 5, piston housing 30 preferably includes two screw holes 50 for receiving screws (not shown) to secure the piston (shown in FIG. 3A) in piston port 44.

In a preferred embodiment, piston 45 is retained within piston port 44 by a block retainer (not shown) disposed on the outside shoulder of piston housing 30. The block retainer permits piston 45 to pass through the block retainer, but stops piston 45 from falling out of piston port 44. Block retainers for pistons are known to persons skilled in the art.

Piston 45 can be any appropriately sized piston known by persons of ordinary skill in the art that is capable of actuating upon exposure to a pre-determined pressure and can release split ring 80 for setting slips 70 and, thus, installation of liner hanger 10 within a wellbore. In one embodiment, piston 45 includes rupture disk 47 (shown in FIG. 3A). Rupture disk 47 is designed to break-away at a predetermined depth due to hydrostatic pressure of the well fluid or fluid pressures applied by pumps at the surface of the well. Rupture disks 47 are known in the art.

Figure 6:
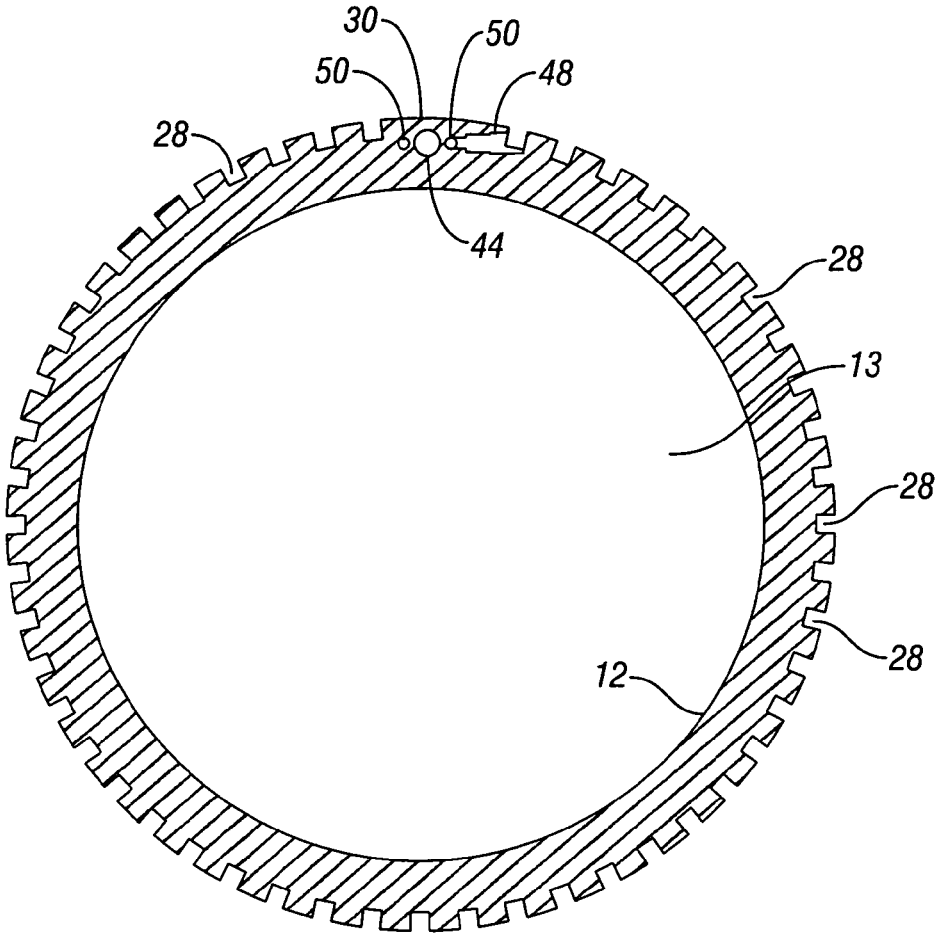
FIG. 6 is a partial cross-sectional view of the piston housing and the spring slots of the mandrel shown in FIG. 2B taken along line 6-6.
Figure 7:
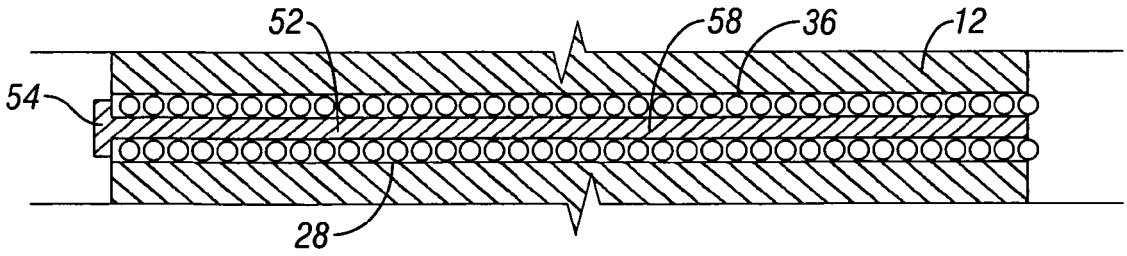
FIG. 7 is a cross-sectional view of a spring placed within a spring slot of the mandrel shown in FIG. 1A.

As illustrated in FIG. 6, mandrel 12 includes a plurality of spring slots 28. Each spring slot 28 is long and narrow so that each spring slot 28 receives at least one spring 36. As shown in greater detail in FIG. 7, spring 36 preferably includes spring nail 52 having head 54 and shaft 58. Spring 36 shown in FIG. 6 is in its compressed or energized position. When released, as discussed in greater detail below, head 54 of spring nail 52 contacts slip housing 60 and moves slip housing 60 upward to set slips 70. Although spring 36 can be designed to sufficiently move slip housing 60 without the need for spring nail 52, the increased surface area contacting slip housing 60 by head 54 increases the distribution of force acting on slip housing 60 to better facilitate movement of slip housing 60.

Figure 9:
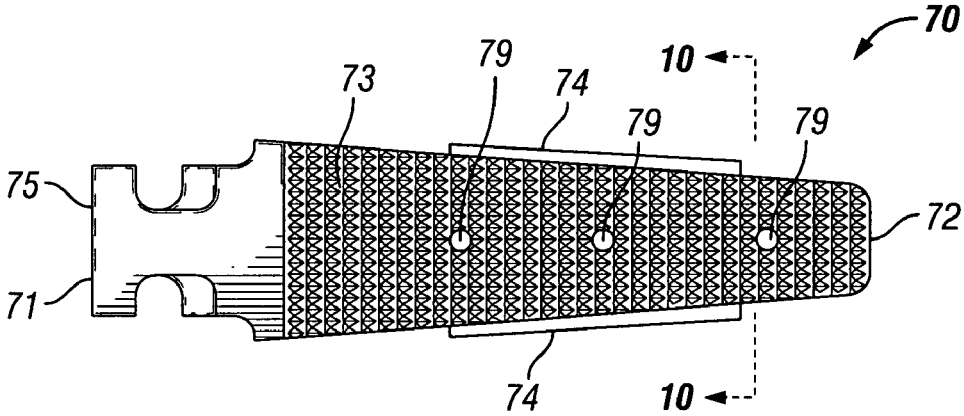
FIG. 9 is a top view of a slip of one specific embodiment of the liner hanger disclosed herein.
Figure 10:
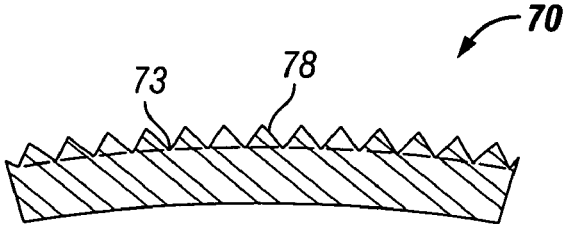
FIG. 10 is a cross-sectional view of the slip shown in FIG. 9 taken along line 10-10.

Referring now to FIG. 8, slip housing 60 includes slots 61, preferably includes T-slots 62, for receiving slips 70 (FIGS. 9-10). As shown in FIG. 8, slip housing 60 is formed from three pieces secured together by, for example, screws (not shown) inserted through screw holes 64. During shipment, slip housing 60 can be secured to outer wall surface 24 of mandrel 12 by fasteners such as a screw (not shown) disposed through hole 63 (FIG. 8) and contacting spot-faced hole 31 (FIG. 1A). Prior to running liner hanger 10 into a well, the screw is removed so that slip housing 60 can move from its run-in position (FIG. 3A) to its set position (FIG. 3D).

Slip housing 60 includes split ring groove 66 and key slot 68. Key slot 68 has shear screw hole 69 for receiving a shear screw 67 (shown in FIGS. 3A and 3B) to maintain key 90 (as shown in FIG. 3A) in place until piston 45 is actuated.

Each slip 70 (FIGS. 9-10) is an elongated member with first end 71, second end 72, gripping wall surface 73, and ramps 74. Although, first end 71 may include having any design or shape known to persons of ordinary skill in the art to facilitate connection of slip 70 to slip housing 60, in a preferred embodiment, first end 71 includes a T-shaped extension 75 for matingly engaging T-shaped slots 62 of slip housing 60. It is to be understood, however, that first end 71, as well as slip housing slots 61, can have any shape desired for matingly engaging slip 70 with slip housing 60.

Gripping wall surface 73 may have wickers or any other configuration that facilitates gripping wall surface 73 to grip or bite into the wellbore casing. For example, gripping wall surface 73 includes a plurality of pyramid-shaped "teeth" 78 as illustrated in FIGS. 9-10. Alternatively, gripping wall surface 73 may be profiled with grippers formed of carbide or other material, velcro material, ball bearings, or spray-on grit surfaces, or any other material that facilitates increased friction or provides surface penetration of the gripping wall surface 73 into the wellbore casing. In a preferred embodiment, gripping wall surface 73 is curved or convex, having the same curvature as mandrel 12 and wellbore casing (not shown). In one specific embodiment, gripping wall surface 73 is a cam surface causing a camming motion against the wellbore casing to facilitate securing hanger liner 10 to the wellbore casing. Gripping wall surface 73 may also include holes 79 for receiving carbide buttons (not shown) and/or for fixture purposes.

Split ring 80 is illustrated in FIG. 11 as having opposed shoulders 82, 84 which are outwardly biased away from each other. In other words, a force is required to squeeze opposed shoulders 82, 84 toward one another.

Figure 12:
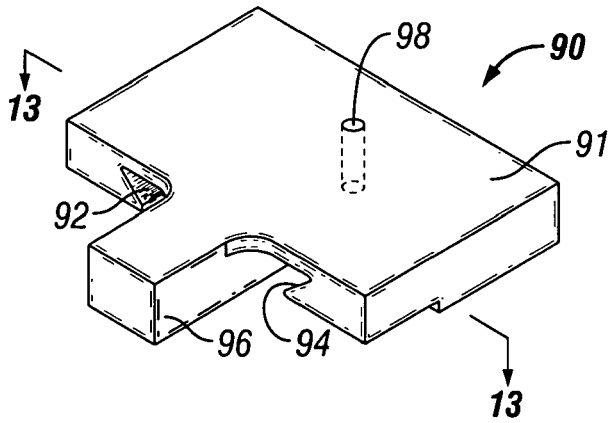
FIG. 12 is a perspective view of the key of one specific embodiment of the liner hanger disclosed herein.
Figure 13:
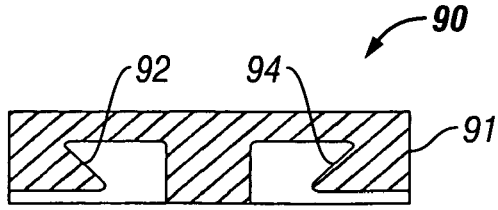
FIG. 13 is a cross-sectional view of the key shown in FIG. 12 taken along line 13-13.

Split ring 80 is held in its energized position, i.e., opposed shoulders 82, 84 are held close together, by key 90 shown in FIGS. 12-13. Key 90 has a body 91, a pair of opposed surfaces 92, 94, tab 96, and shear screw hole 98 for receiving shear screw 67 (shown in FIGS. 3A and 3B). FIG. 3C shows key 90 with split ring 80 held by key 90. FIG. 3C also shows the area through which split ring 80 slides as key 90 is moved by piston 45 to release split ring 80 as discussed in greater detail below.

Opposed surfaces 92, 94 engage shoulders 82, 84, respectively, to hold the position of split ring 80 to a diameter that can effectively serve as an anchor when fixed in split ring groove 29. Split ring 80 is held by key 90 within in split ring groove 29 and, thus, within ring groove 66 of slip housing 60, and key 90 is held within key slot 68 of slip housing 60 by shear screw 67 until liner hanger 10 is actuated, i.e., set within the wellbore casing.

In setting liner hanger 10 within wellbore casing, pressure builds up within in bore 13 of the mandrel 12. After sufficient pressure is reached, the pressure is communicated through communication port 46 to break rupture disk 47 which in turn actuates piston 45. Piston 45, which is in communication with tab 96, forces key 90 upward in the direction of the arrow (FIGS. 3A and 3D). As a result, shear screw 67 is broken and key 90 moves in the direction of the arrow in FIGS. 3A and 3D. As key 90 is pushed upward, opposed shoulders 82, 84 of split ring 80 slide out of and way from surfaces 92, 94 of key 90 and, as a result, split ring 80 is released from key 90 and expands outwardly to its original shape (shown in FIG. 11) and into split ring groove 66 of slip housing 60.

Due to the release of split ring 80, slip housing is permitted to move and, therefore, springs 36 are permitted to expand and release their stored energy. Accordingly, each spring 36 expands with head 54 of spring nail 52 pushing slip housing 60 upward in the direction of the arrow in FIGS. 3A and 3D. As slip housing 60 moves upward, each slip 70 within each slip pocket 26 is moved axially, however, slip ramps 74 slidingly engaged within slip grooves 27 force each slip to expand radially outward from mandrel 12 (FIG. 3D). Therefore, as slip housing 60 moves upward, each slip moves upward and outward so that gripping wall surface 73 bites into the inner wall surface of the wellbore casing. Thus, the entire actuation of liner hanger 10 from its initial or run-in position (FIG. 3A) to its set position (FIG. 3D) occurs in same direction which is believed to allow for setting of the liner hanger 10 with less force from springs 36.

It is to be understood that the invention is not limited to the exact details of construction, operation, exact materials, or embodiments shown and described, as modifications and equivalents will be apparent to one skilled in the art. For example, the piston housing and spring slots are shown as being formed from the same piece of material as the mandrel. However, the spring slots and piston housing could be formed by one or more pieces separately from the mandrel that is/are then secured to the outer wall surface of the mandrel. Additionally, actuation of the piston may be done through any device, e.g., rupture disk, or method, e.g., pumping fluid from the surface, known to persons of ordinary skill in the art. Moreover, the size and number of springs may be modified as desired or necessary to increase or decrease the total stored energy of the springs. Moreover, the slips may have any size and shape, and may include any type of gripping profile, desired or necessary to provide axially and radially extension to bite into the inner wall surface of the wellbore casing. Further, more than one piston may be utilized to push the key and release the split ring and one or more key may be utilized to hold the slip housing in place so that a heavier slip housing or heavier slips may be used in larger liner hangers. Accordingly, the invention is therefore to be limited only by the scope of the appended claims.

What is claimed is:

1. A liner hanger for securing to the inner wall of a wellbore casing and having an initial run-in position and a set position, the liner hanger comprising:

a mandrel having an inner wall surface defining a bore and an outer wall surface, the outer wall surface having at least one slip pocket, a plurality of spring slots, each spring slot having at least one spring disposed therein, and a piston housing, the piston housing having at least one piston disposed therein, wherein the piston is in fluid communication with the bore;

a slip housing disposed below the piston housing and each of the spring slots, the slip housing being slidingly engaged with the outer wall surface of the mandrel and having at least one slip operatively associated therewith, each of the at least one slips being disposed within a corresponding slip pocket; and a retainer, wherein the slip housing is held in the run-in position by the retainer so that each of the slips is disposed within each of the corresponding slip pockets, and wherein actuation of the piston causes the retainer to release the slip housing allowing each of the plurality of springs to move the slip housing upward axially from the run-in position to the set position which causes each of the slips to move upward axially and radially relative to the corresponding slip pockets and the mandrel to engage the inner wall of the wellbore casing.

2. The liner hanger of claim 1, wherein the mandrel includes a split ring groove and the retainer is a split ring disposed within the split ring groove, the split ring being operatively associated with a key.

3. The liner hanger of claim 2, wherein the slip housing includes an inner wall surface having a groove for receiving the split ring and a pocket for receiving the key and wherein the slip housing contacts each of the plurality of springs when the liner hanger is in the run-in position.

4. The liner hanger of claim 3, wherein the key is in contact with the piston when the liner hanger is in the run-in position.

5. The liner hanger of claim 4, wherein the key is held in place by a shear screw when the liner hanger is in the run-in position.

6. The liner hanger of claim 5, wherein the key includes a body, a pair of opposed surfaces, a tab, and a shear screw hole for receiving the shear screw, the pair of opposed surfaces being matingly engaged with a corresponding pair of opposed shoulders on the split ring when the liner hanger is in the run-in position.

7. The liner hanger of claim 1, further comprising a spring adjustment sleeve for compressing and maintaining each of the springs within the corresponding spring slots when the liner hanger is in the run-in position.

8. The liner hanger of claim 7, wherein the spring adjustment sleeve includes threads on an inner wall surface of the spring adjustment sleeve.

9. The liner hanger of claim 7, further comprising an adjustment sleeve ring for securing the spring adjustment sleeve to the mandrel and wherein the spring adjustment sleeve includes a protrusion slidingly engaged with a slot on the mandrel for aligning the spring adjustment sleeve on the mandrel.

10. The liner hanger of claim 9, wherein the adjustment sleeve ring includes a set screw for preventing the adjustment sleeve ring from loosening.

11. The liner hanger of claim 10, wherein the adjustment sleeve ring includes threads for securing the adjustment sleeve ring to the outer wall surface of the mandrel.

12. The liner hanger of claim 7, wherein the spring adjustment sleeve includes a shoulder for abutting each of the springs.

13. The liner hanger of claim 1, wherein each of the plurality of slips includes a first end having a T-shaped protrusion that matingly engages with a T-slot in the slip housing.

14. The liner hanger of claim 1, wherein the piston housing comprises a piston port having a length and a vent port disposed along the piston port length and in fluid communication with the piston port and an environment outside the mandrel.

15. The liner hanger of claim 1, wherein each of the springs includes a spring nail.

16. The liner hanger of claim 1, wherein each of the plurality of slips includes a gripping wall surface having pyramidal-shaped teeth.

17. An improved liner hanger having a run-in position and a set position, the improvement comprising:

a plurality of spring slots disposed on an outer wall surface of a mandrel, at least one of the plurality of spring slots having at least one spring disposed therein, wherein each of the at least one springs is held within the corresponding spring slots by a slip housing and a spring adjustment sleeve disposed on the outer wall surface of the mandrel when the liner hanger is in the run-in position, wherein the spring adjustment sleeve includes a shoulder disposed on an inner wall surface of the spring adjustment sleeve, and wherein the inner wall surface of the spring adjustment sleeve includes threads for securing the spring adjustment sleeve to the outer wall surface of the mandrel.

18. A method of setting a liner hanger within a wellbore casing of a well, the method comprising:

(a) disposing a liner hanger within a wellbore, the liner hanger having an initial run-in position and a set position and the liner hanger comprising a mandrel having an inner wall surface defining a bore and an outer wall surface, the outer wall surface having at least one slip pocket, a split ring groove, a plurality of spring slots, each spring slot having at least one spring disposed therein, and a piston housing, the piston housing having at least one piston disposed therein, wherein the piston is in fluid communication with the bore, and a slip housing disposed below the piston housing and each of the spring slots, the slip housing being slidingly engaged with the outer wall surface of the mandrel and having at least one slip operatively associated therewith, each of the at least one slips having a gripping wall surface and being slidingly engaged within a corresponding slip pocket, wherein the slip housing is held in the run-in position by a retainer so that each of the slips is disposed within each of the corresponding slip pockets;

(b) actuating the piston through an increase in pressure in the bore of the mandrel, wherein the actuation of the piston releases the retainer so that the slip housing is permitted to move axially along the outer wall surface of the mandrel and each of the springs is permitted to expand in an upward direction; and (c) expanding in the upward direction each of the springs sufficiently to move the slip housing axially in the upward direction so that each of the plurality of slips move axially in the upward direction causing each of the slips to move in the upward direction and in an outward direction so that the gripping profile surface of each of the slips bites into an inner wall surface of the wellbore casing.

19. The method of claim 18, wherein each of the slip pockets include at least one groove for receiving at least one slip ramp disposed on at least one of the slips so that during step (c) movement of each of the slips is guided by the at least one groove.

* * * * *